US006792880B2

(12) United States Patent
Tsai

(10) Patent No.: US 6,792,880 B2
(45) Date of Patent: Sep. 21, 2004

(54) FOLDABLE TABLE

(76) Inventor: Tony Tsai, 4F-3, Fu Chin St., Song Shan Dist., Taipei (TW)

( * ) Notice: Subject to any disclaimer, the term of this patent is extended or adjusted under 35 U.S.C. 154(b) by 105 days.

(21) Appl. No.: 10/263,752

(22) Filed: Oct. 4, 2002

(65) Prior Publication Data

US 2004/0065237 A1 Apr. 8, 2004

(51) Int. Cl.[7] ..... A47B 3/00
(52) U.S. Cl. ..... 108/115
(58) Field of Search ..... 108/115, 35, 34, 108/36, 38, 41, 117, 157.18, 118; 248/166, 436, 165, 434, 188.6

(56) References Cited

U.S. PATENT DOCUMENTS 1,185,568 A * 5/1916 Zuenert ..... 108/115
5,865,127 A * 2/1999 Carter ..... 108/115
6,026,751 A * 2/2000 Tsai ..... 108/34
6,073,894 A * 6/2000 Chen ..... 248/165
6,079,338 A * 6/2000 Yeh ..... 108/115
6,199,489 B1 * 3/2001 Tsai ..... 108/115
6,234,089 B1 * 5/2001 Zheng et al. ..... 108/115
6,283,045 B1 * 9/2001 Izumi ..... 108/115
6,640,730 B2 * 11/2003 Tsai ..... 108/115

* cited by examiner

*Primary Examiner*—Jose V. Chen
(74) *Attorney, Agent, or Firm*—Rosenberg, Klein & Lee

(57) ABSTRACT

A foldable table includes four legs, two first slide carriages, two second slide carriages, two first linkages, two second linkages, two supports and two tabletops. Four fixation holders, the first and the second slide carriages are inserted to the legs while the first and the second linkages are respectively pivoted to where between the fixation holders and the first, and the second slide carriages. The two supports are pivoted to the front and the rear of the legs; and the tabletops are pivoted to the second slide carriages to achieve easy and fast folding of the table when its use is not required.

12 Claims, 24 Drawing Sheets

FOLDABLE TABLE

BACKGROUND OF THE INVENTION (a) Field of the Invention

The present invention is related to a foldable table, and more particularly, to one that with first linkages, second linkages and supports being respectively pivoted to legs while tabletops being pivoted to second slide carriages for fast and easy folding of the table when its use is not required.

(b) Description of the Prior Art

Whereas, most of the tables generally used are provided in fixed structure and prevented from being folded when not in use, they consumes too much space for storage or for handling. The problems become even more serious nowadays as the living space of each home is very limited. Even though there are many types of foldable tables generally available in the market, only the legs, not the tabletops are also foldable, they are incapable of minimizing the storage space, the same problems of difficult handling and consuming too much space remain unsolved.

SUMMARY OF THE INVENTION

The first purpose of the present invention is to provide to a foldable table that can be easily folded to its minimum volume for being portable and storage with the least space.

DETAILED DESCRIPTION OF THE PREFERRED EMBODIMENTS

Figure 1:
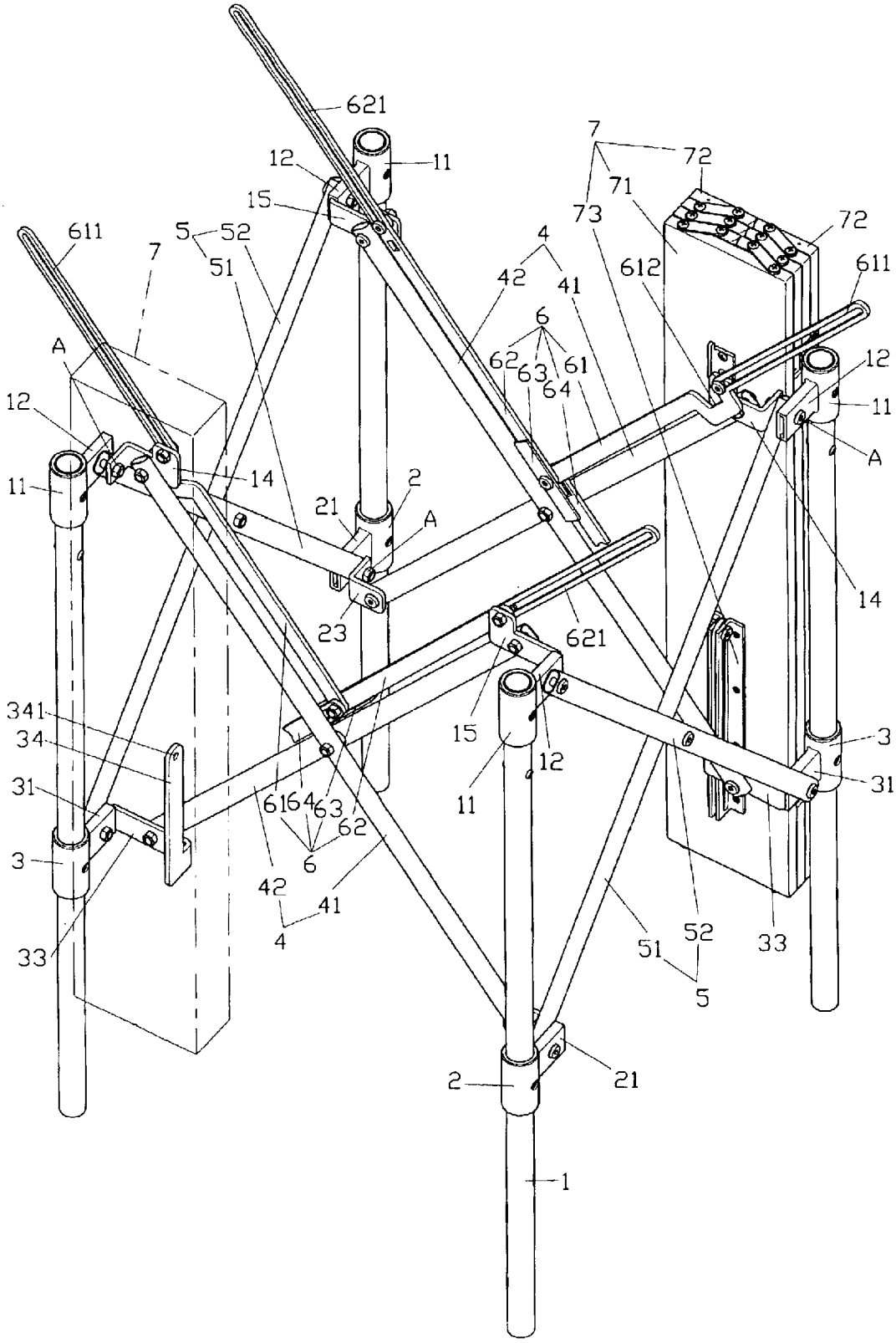
FIG. 1 is a perspective view of a preferred embodiment of the present invention.
Figure 2:
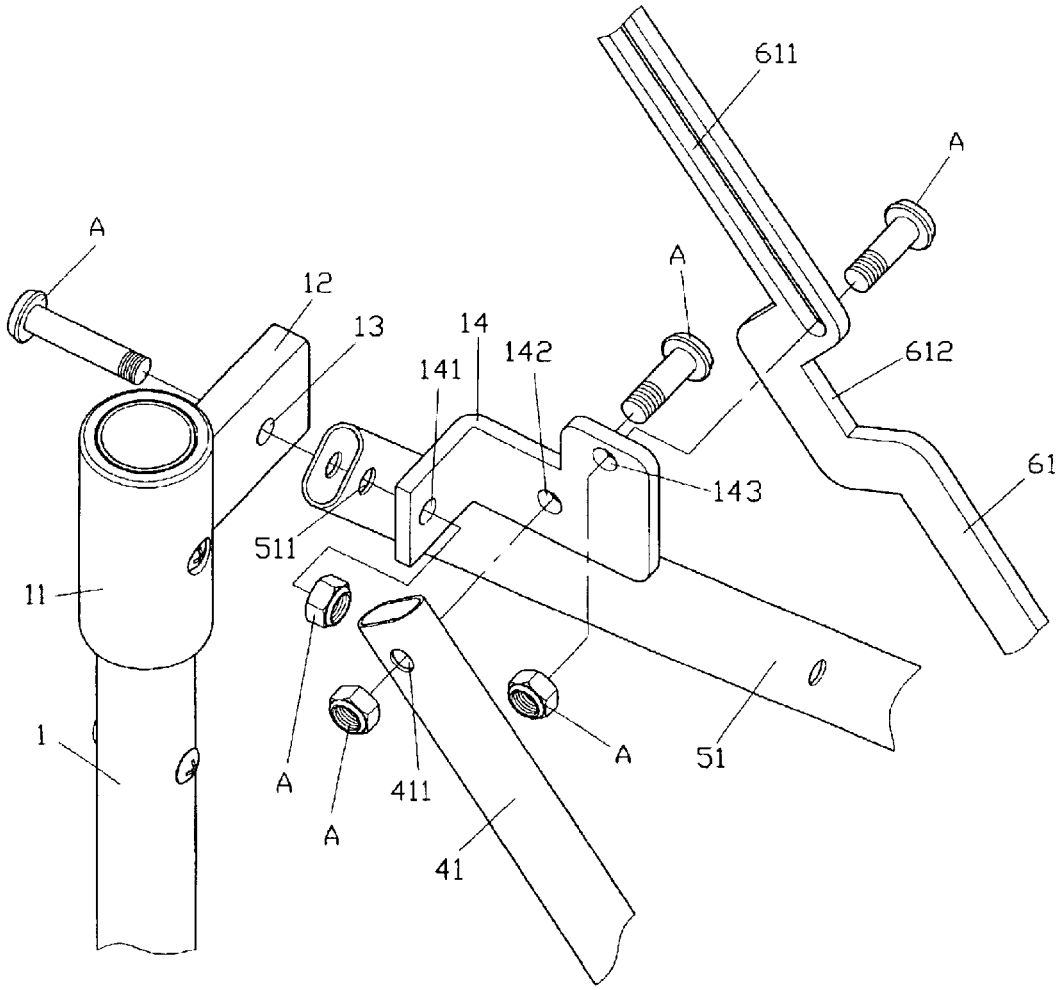
FIG. 2 is an exploded view of a first connector of the present invention.

Referring to FIGS. 1 and 2, the present invention is essentially comprised of four legs (1), two first slide carriages (2), two second slide carriages (3), two first linkages (4), two second linkages (5), two supports (6) and two tabletops (7).

Figure 3:
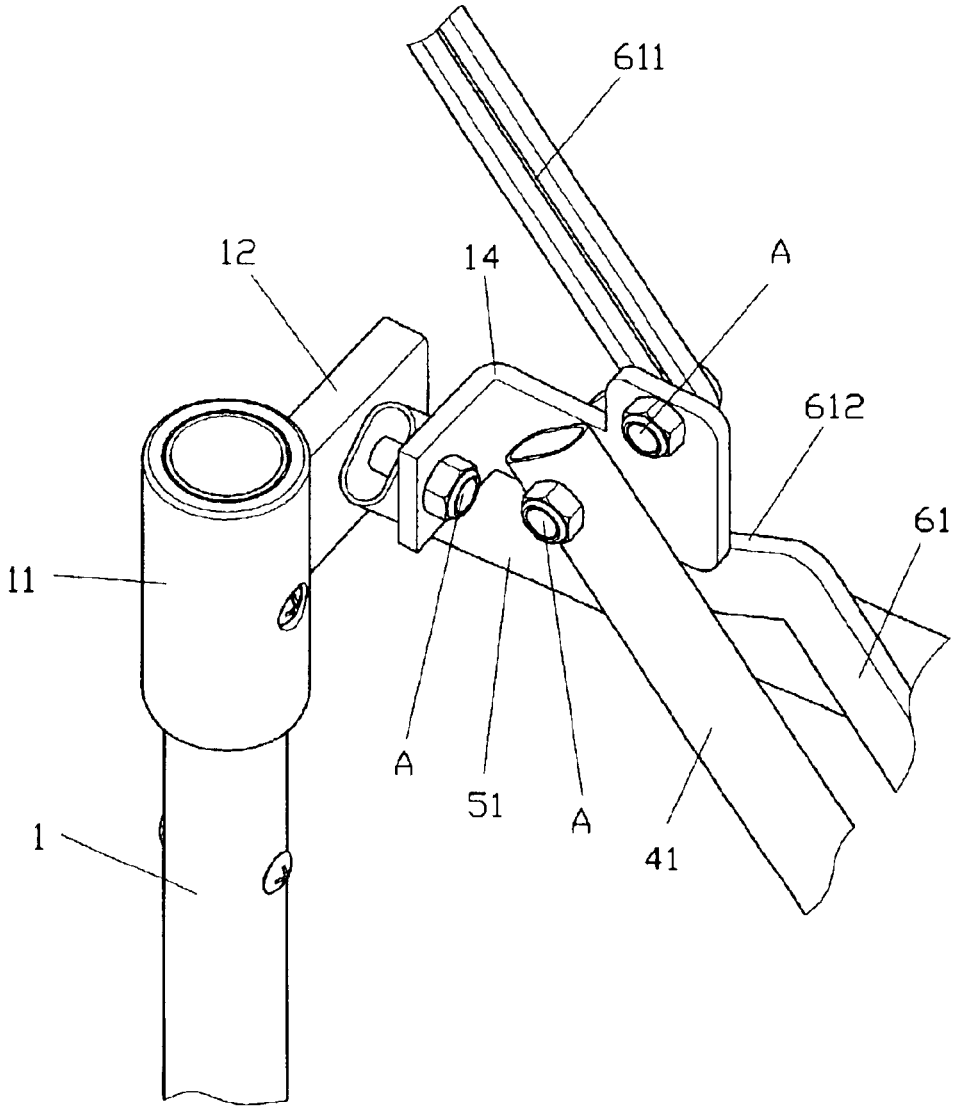
FIG. 3 is a perspective view of the first connector the present invention as assembled.
Figure 4:
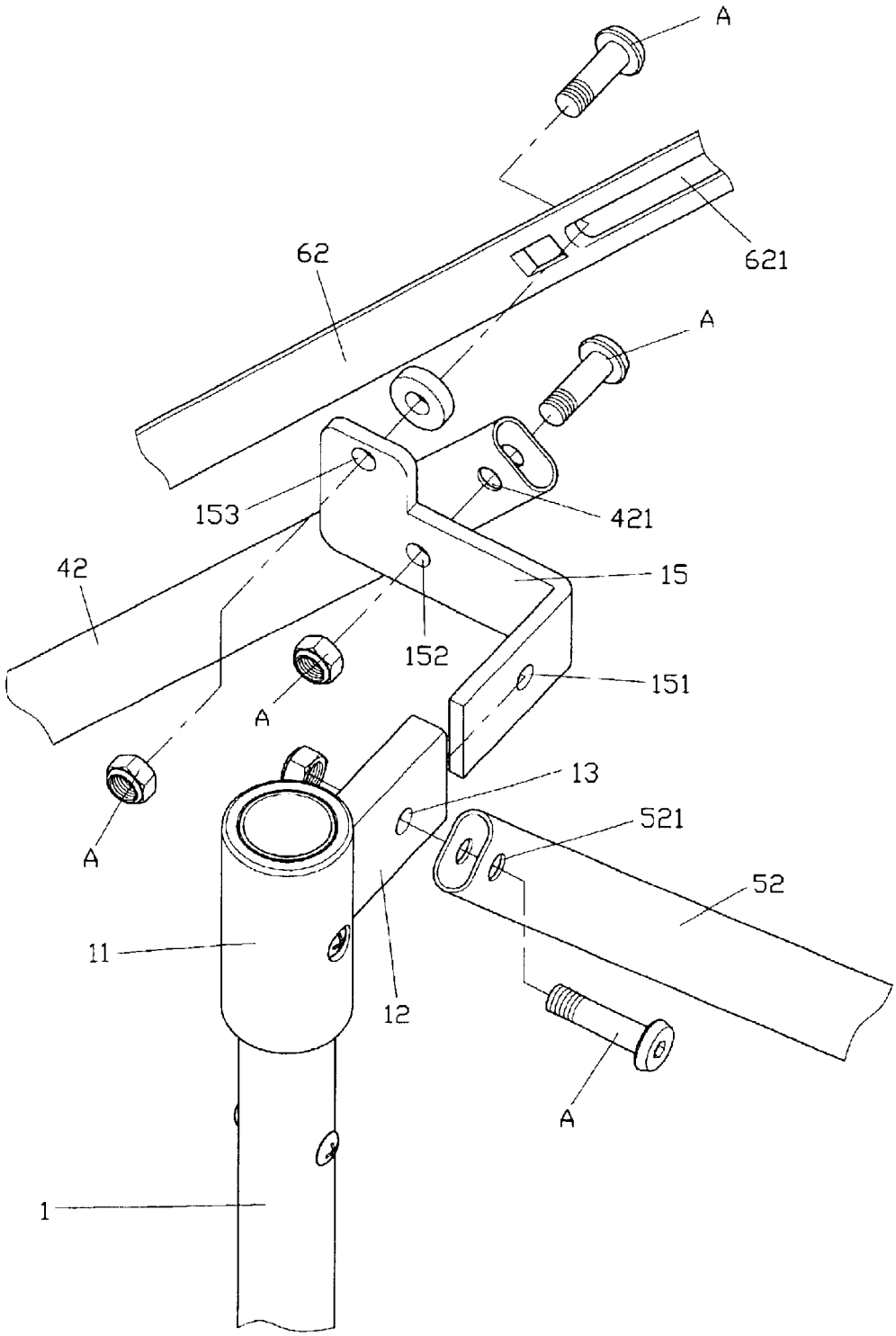
FIG. 4 is an exploded view of a second connector of the present invention.
Figure 5:
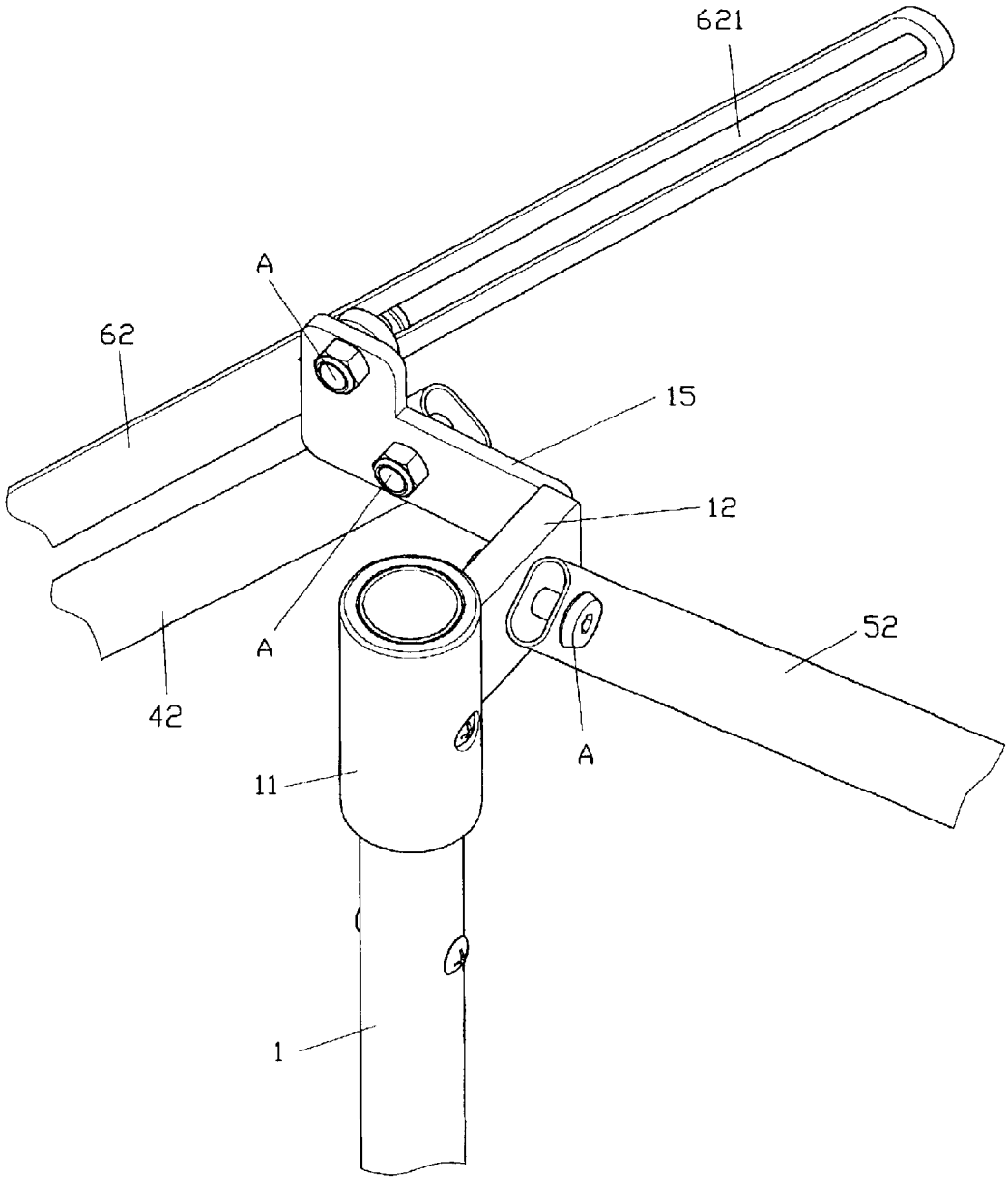
FIG. 5 is a perspective view of the second connector of present invention as assembled.

The four legs (4) are provided with each related to a rod having at the top secured with a fixation holder (11), and a pivot (12) protruded from the fixation holder (11) is further provided with a hole (13). The hole (13) in the pivot (12) of the fixation holder (11) of each of two out of the four legs (11) in opposite to each other are each pivoted to a first connector (14) by means of a pivoting element (A) (including a bolt and a nut) as illustrated in FIGS. 2 and 3. Each of the two first connectors (14) indicates an "L" shape having at one side provided with a first hole (141) in relation to the hole (13) in the pivot (12), and a second and a third holes (142, 143) are provided on the other side of each of the two first connectors (14). Each hole (13) in the pivot (12) of the fixation holder (11) of each of another two legs (1) is pivoted through a pivoting element (A) to a second connector (15) as illustrated in FIGS. 4 and 5. Each of the two second connectors (15) indicates an "L" shape. On one side of the second connector (15) is provided with a first hole (151) in relation to the hole (13) in the pivot (12), and a second and a third holes (152, 153) on the other side.

Figure 6:
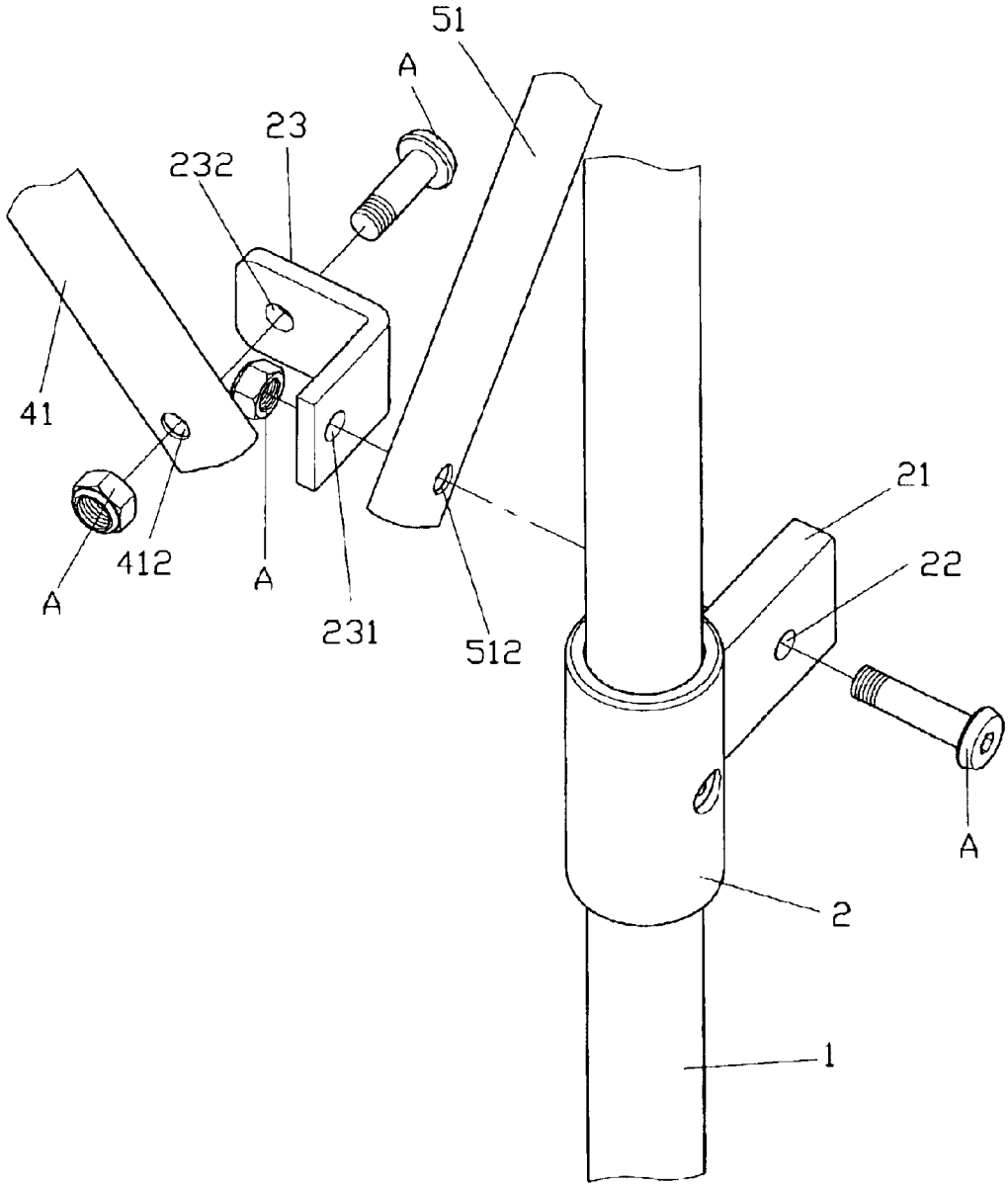
FIG. 6 is an exploded view of a third connector of the present invention.
Figure 7:
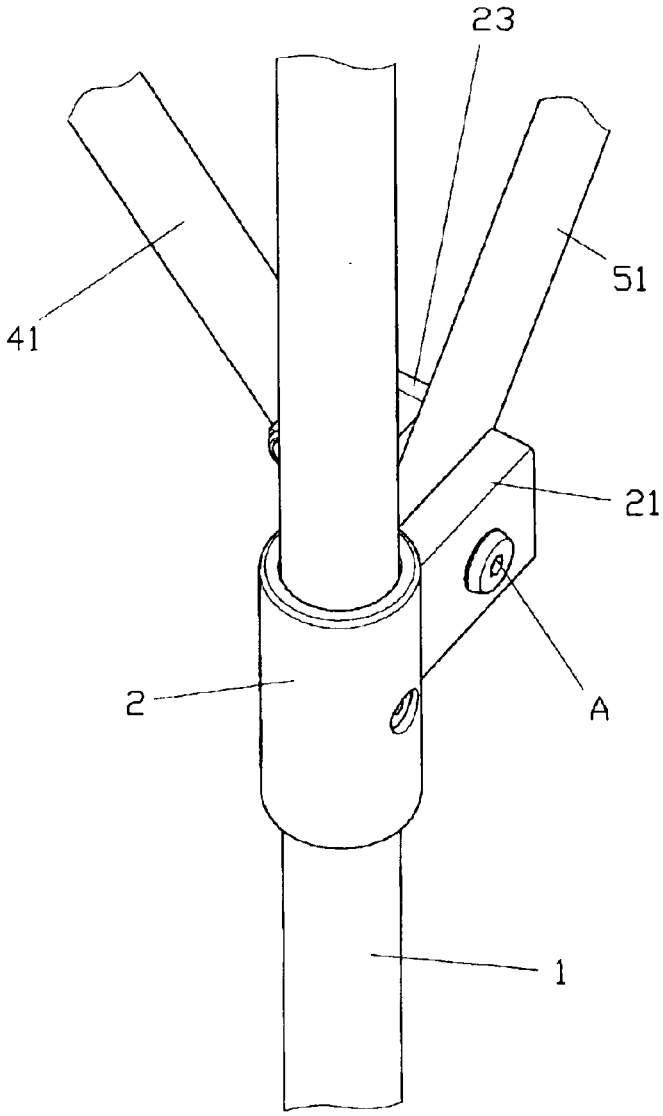
FIG. 7 is a perspective view of the third connector of the present invention as assembled.

Now referring to FIGS. 6 and 7, the two first slide carriages (2) are provided with each respectively inserted to and slide on two legs (1) opposite to each other. A pivot (21) is protruded from each of the two first slide carriages (2) and a hole (22) is provided in the pivot (21). Each of the two holes (22) is pivoted to a third connector (23) by means of a pivoting element (A). The third connector (23) indicates an "L" shape, and each of the two third connectors (23) is provided on one side with a first hole (231) and one the other side a second hole (232).

Figure 8:
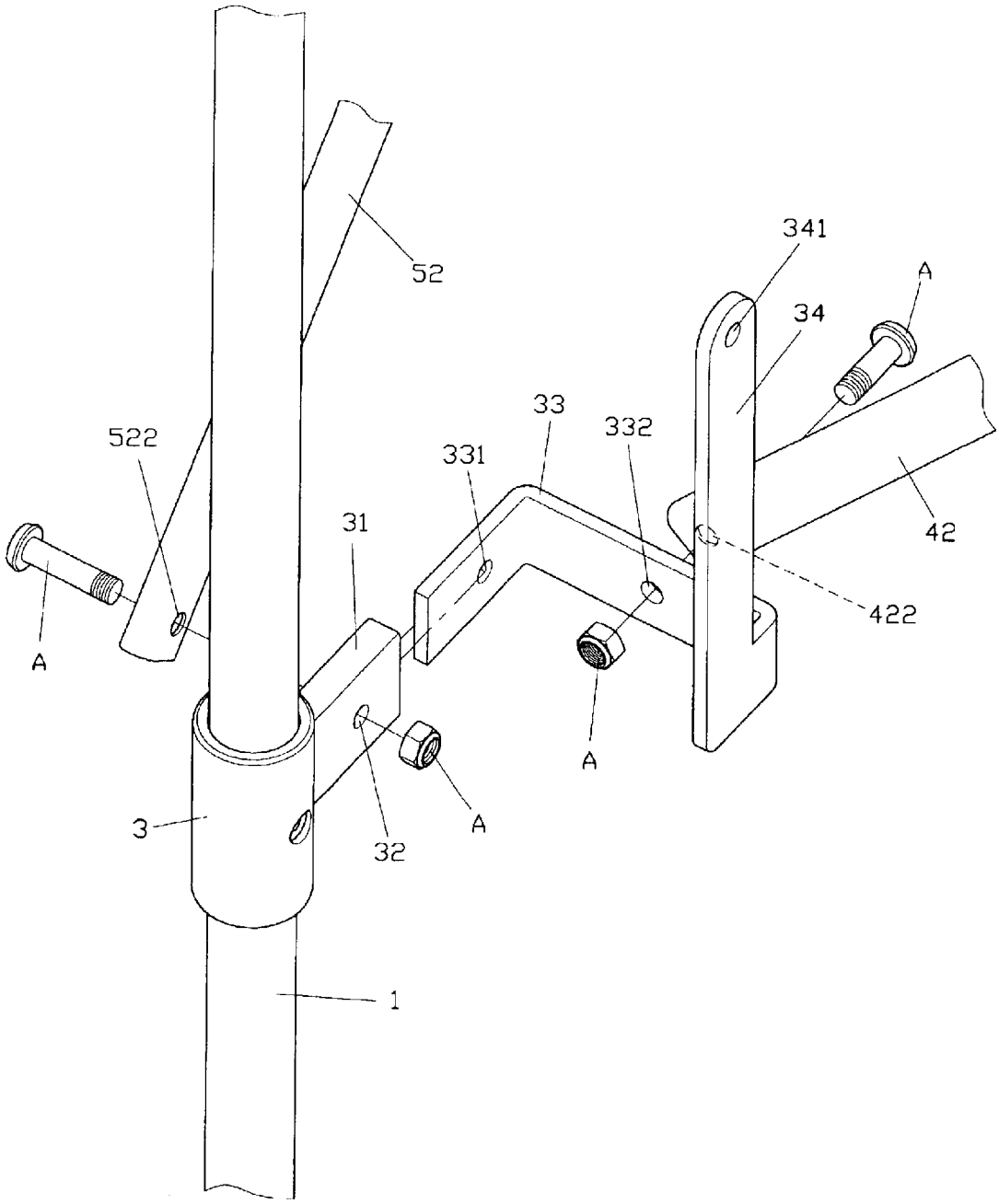
FIG. 8 is an exploded view of a fourth connector of the present invention.
Figure 9:
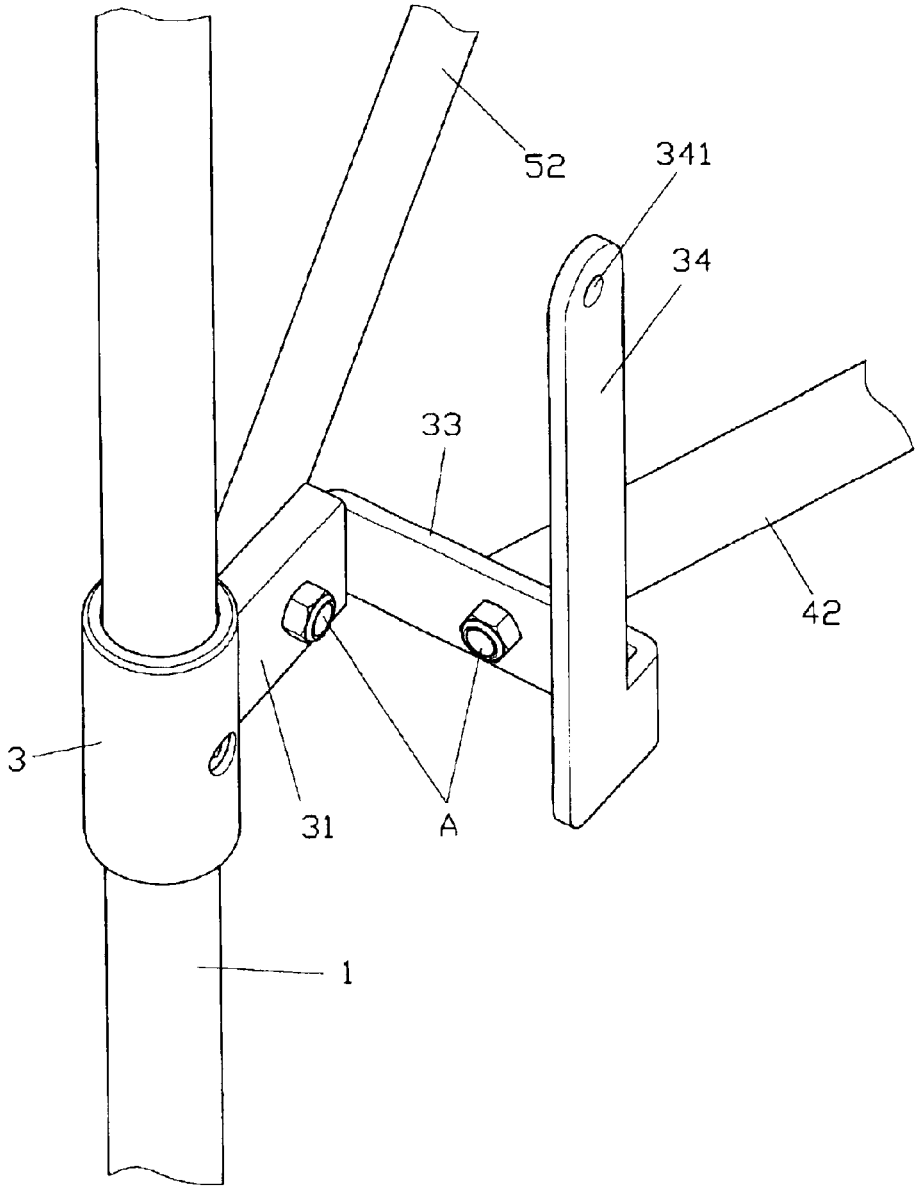
FIG. 9 is a perspective view of the fourth connector of the present invention as assembled.

As illustrated in FIGS. 8 and 9, the two second slide carriages (3) are respectively inserted into and slide along two out of the four legs (1) opposite to each other. A pivot (31) is protruded from each of the two second slide carriages and each of the two pivots (31) is provided with a hole (32) to be pivoted to a fourth connector (33) by means of a pivoting element (A). The fourth connector (33) has provided on one side a first hole (331); at its middle, a second hole (332) and one the other side, a slider (34)) with a hole (341).

There are two first linkages (4) respectively pivoted to the other two legs (1) opposite to each other, Each of the first linkages (4) indicates an "X" shape and includes a first rod

(41) and a second rod (42) pivoted in cross to each other. Holes (411, 412, 421, 422) are respectively provided on the upper end and the lower end of each of the first and the second rods (41, 42). The hole (411) is pivoted to the second hole (142) in the first connector (14) by means of a pivoting element (A) as illustrated in FIGS. 2 and 3 while the hole (421) is pivoted to the second hole (152) of the second connector (15) by means of another pivoting element (A) as illustrated in FIGS. 4 and 5. The hole (412) is pivoted to the second hole (232) of the third connector (23) by means of a pivoting element (A) as illustrated in FIGS. 6 and 7, and the hole (422) is pivoted to the second hole (332) of the fourth connector (33) by means of another pivoting element (A) as illustrated in FIGS. 8 and 9.

There are two second linkages (5) respectively pivoted to the other two legs (1) opposite to each other. Each of the second linkages (5) indicates an "X" shape and includes a first rod (51) and a second rod (52) pivoted in cross to each other. Holes (511, 512, 521, 522) are respectively provided on the upper end and the lower end of each of the first and the second rods (51, 52). The hole (511) is pivoted between the hole (13) in the pivot (12) and the first hole (141) of the first connector (14) by means of a pivoting element (A) as illustrated in FIGS. 2 and 3 while the hole (521) is pivoted to the hole (13) in the pivot (12) and the first hole (151) of the second connector (15) by means of another pivoting element (A) as illustrated in FIGS. 4 and 5. The hole (512) is pivoted between the hole (22) in the pivot (21) and the first hole (231) of the third connector (23) by means of a pivoting element (A) as illustrated in FIGS. 6 and 7, and the hole (522) is pivoted to the hole (32) in the pivot (31) and the first hole (331) of the fourth connector (33) by means of another pivoting element (A) as illustrated in FIGS. 8 and 9.

Figure 10:
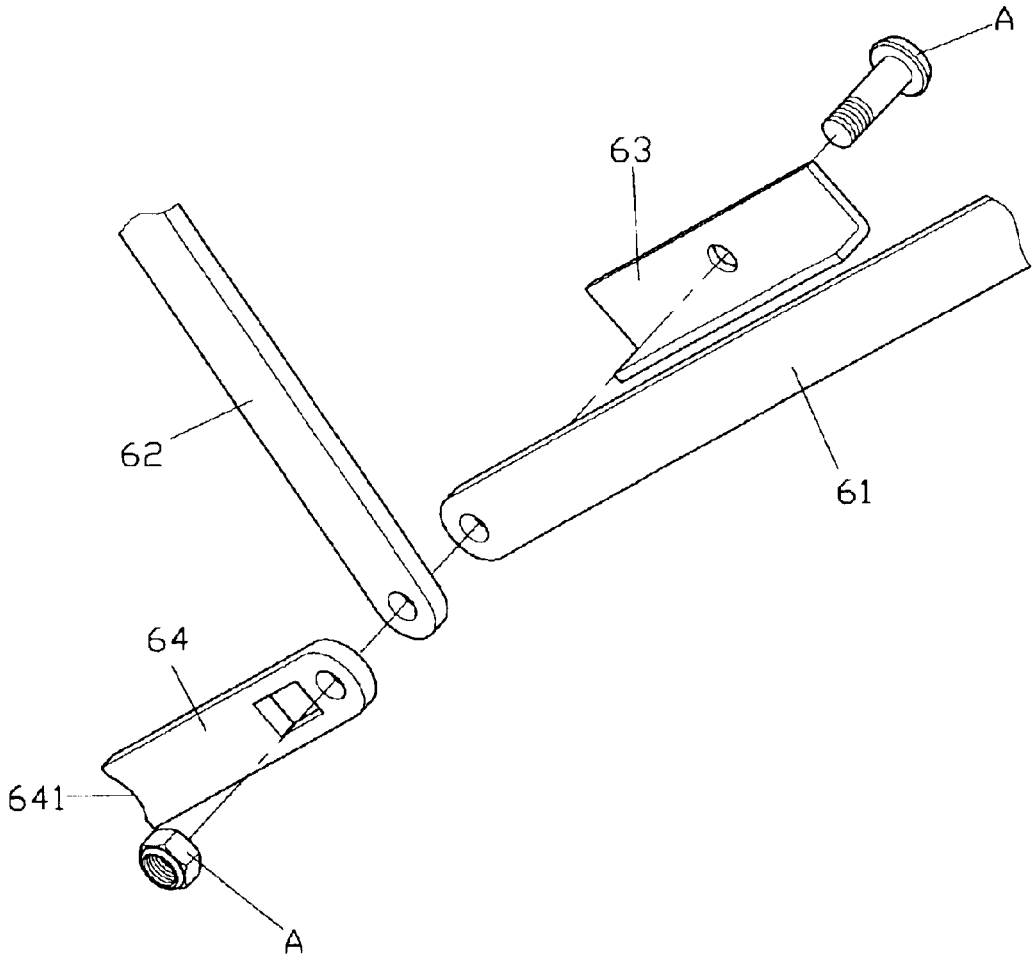
FIG. 10 is a partially exploded view of a support of the preferred embodiment of the present invention.
Figure 11:
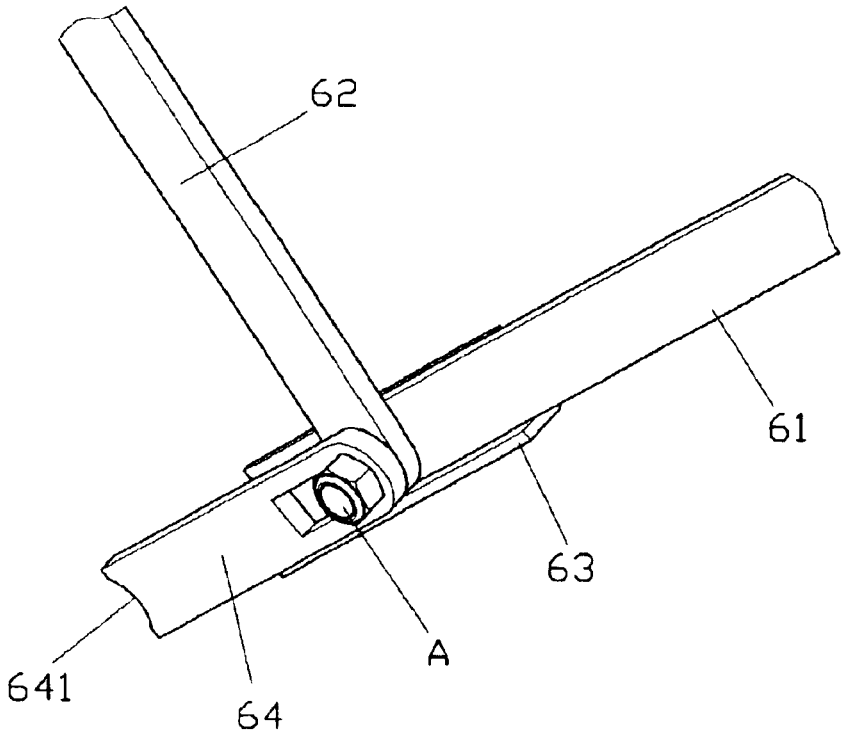
FIG. 11 is a partially perspective view of the support of the present invention as assembled.

The two supports (6) are respectively pivoted to two legs (1) opposite to each other on the same side of the two first linkages (4). Each of the support (6) is comprised of a first rod (61) and a second rod (62) pivoted to each other as illustrated in FIGS. 10 and 11. One end of each of the first and the second rods (61, 62) is pivoted by means of a pivoting element (A) to a pivoting plate (63), which in turn is pivoted to a support plate (64). A support portion (641) is provided below the support plate (64). Another end each of the first and the second rods (61, 62) is respectively provided with a slide way (611, 621). A reception part (612) in recess is provided at a curved portion at where the first rod (61) is close to the terminal of the slide way (611). The slide way (611) is pivoted by means of a pivoting element (A) to the third hole (143) of the first connector (14) as illustrated in FIGS. 2 and 3 while another slide way (621) is pivoted by means of another pivoting element (A) to the third hole (153) of the second connector (15) as illustrated in FIGS. 4 and 5.

Figure 12:
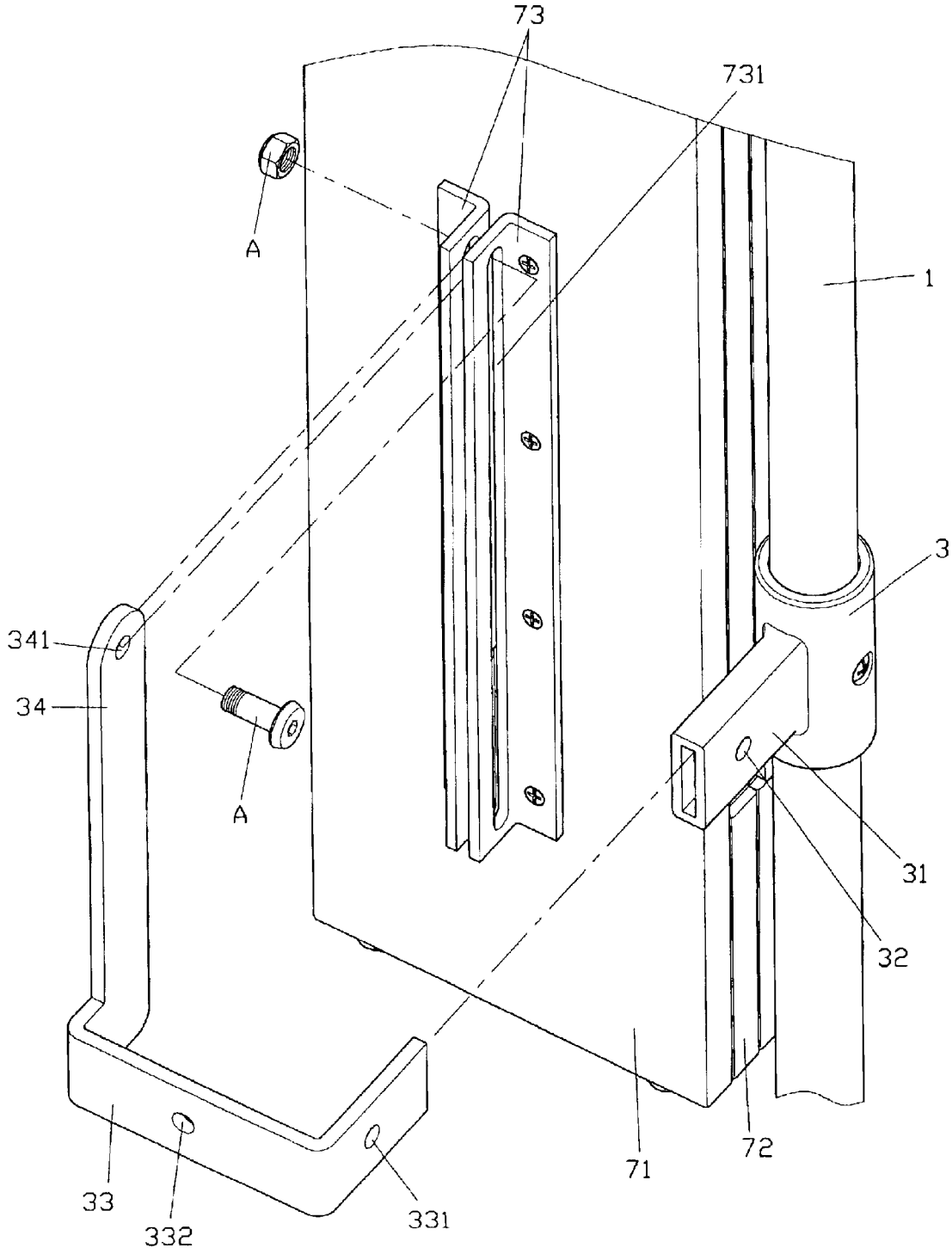
FIG. 12 is an exploded view of a second slide carriage of the present invention.
Figure 13:
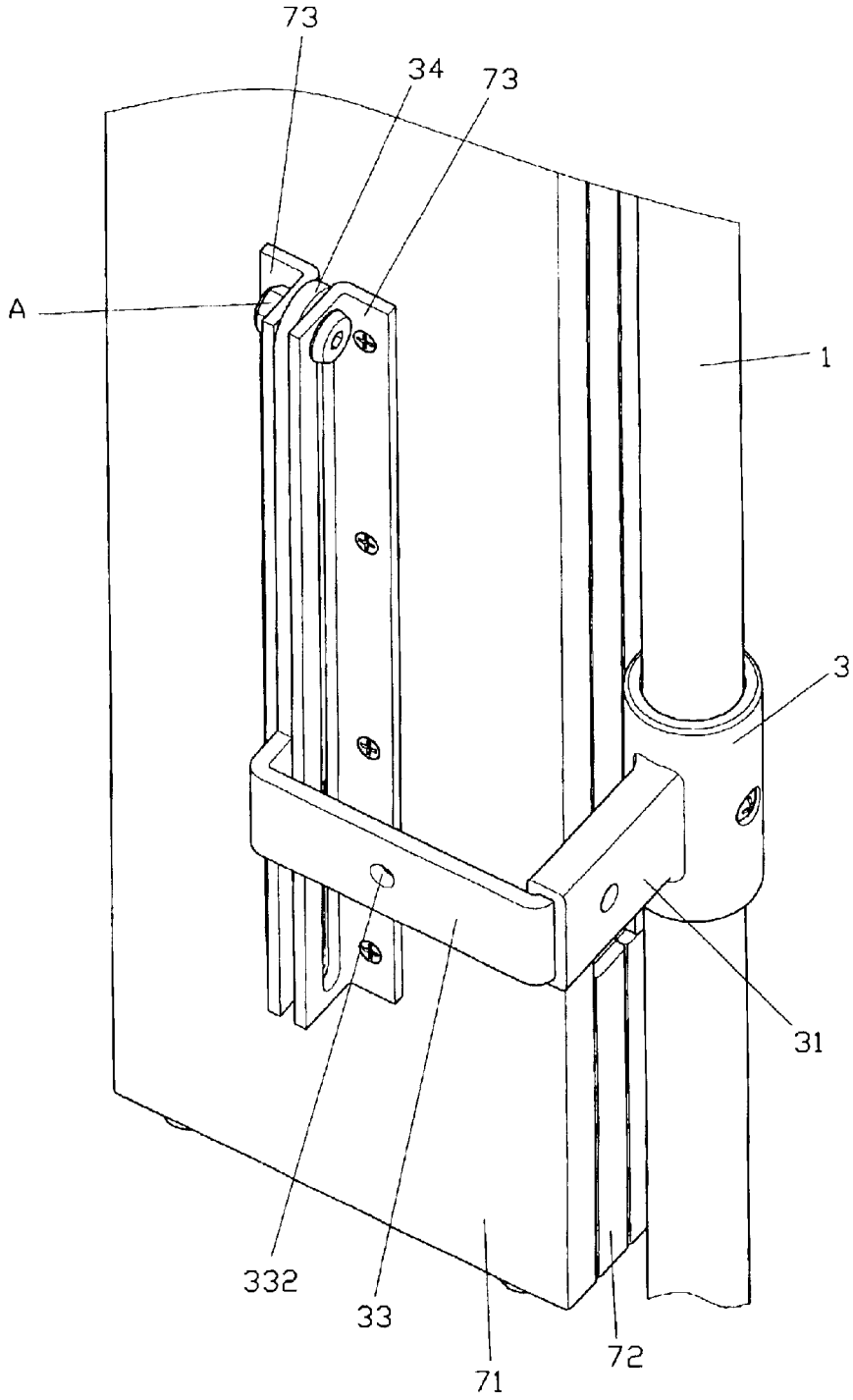
FIG. 13 is a perspective view of the second slide carriage of the preferred embodiment of the present invention as assembled.
Figure 14:
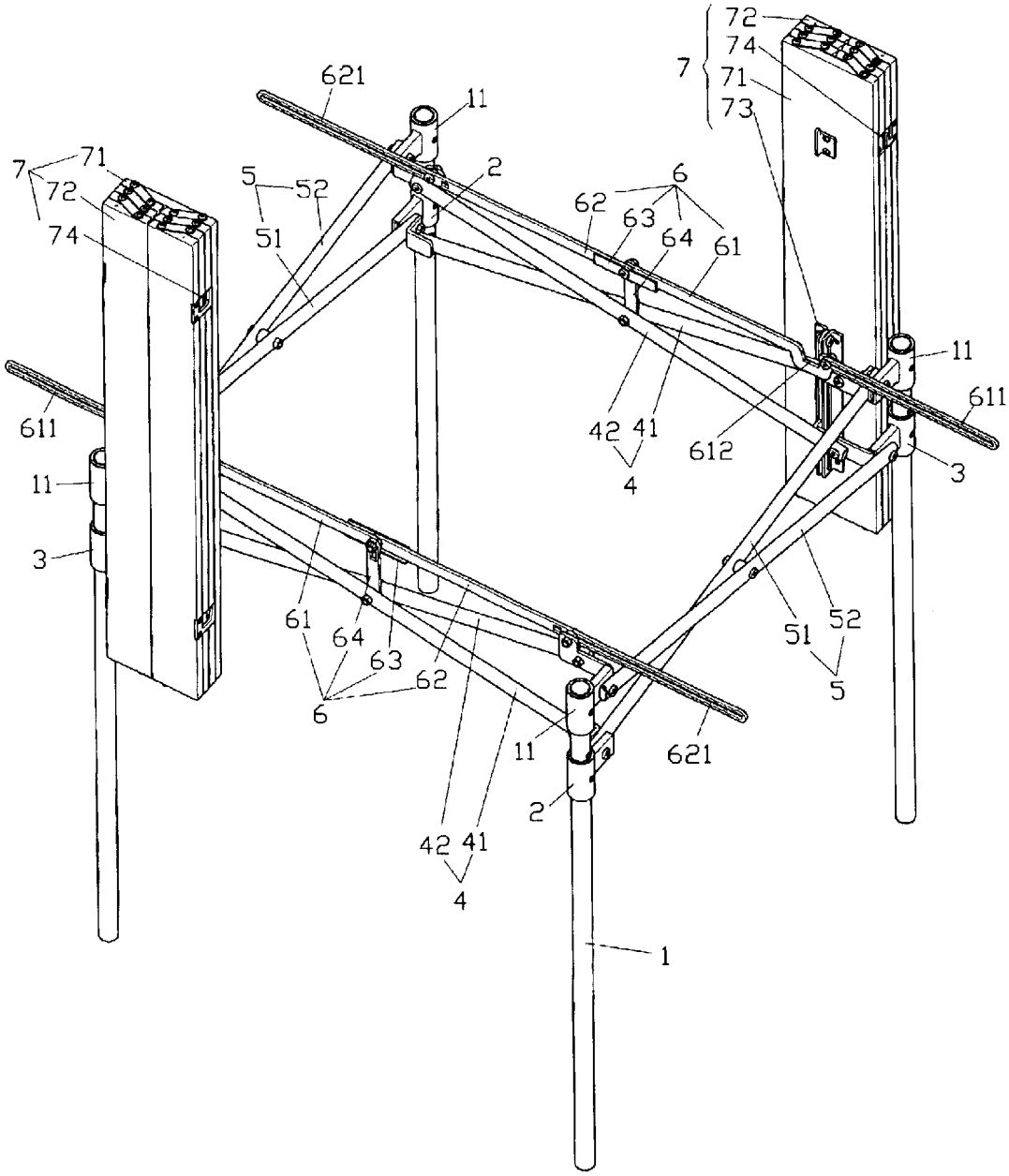
FIG. 14 is a view showing that all four legs of the present invention are fully expanded.

The two tabletops (7) are respectively pivoted to both of the two second, slide carriages (3). Each of the tabletops (7) contains a top panel (71). Each of the two tops (7) is respectively pivoted to a plurality of boards (72) on both sides of the top panel (71). The boards (72) are overlapped in a stack and folded over the top panel (71). Two slide holders (73) facing each other are respectively provided below the panel (71). A slide way (731) is provided over each of the two slide holders (73) for the slider (34) of the second slide carriage (3) is pivoted into the slide way (731) by means of a pivoting element (A) penetrating through the hole (341) as illustrated in FIGS. 12 and 13. Furthermore, on the outer side of each of the two top panels (71) is provided with a locking hook (74), as shown in FIG. 14.

Figure 15:
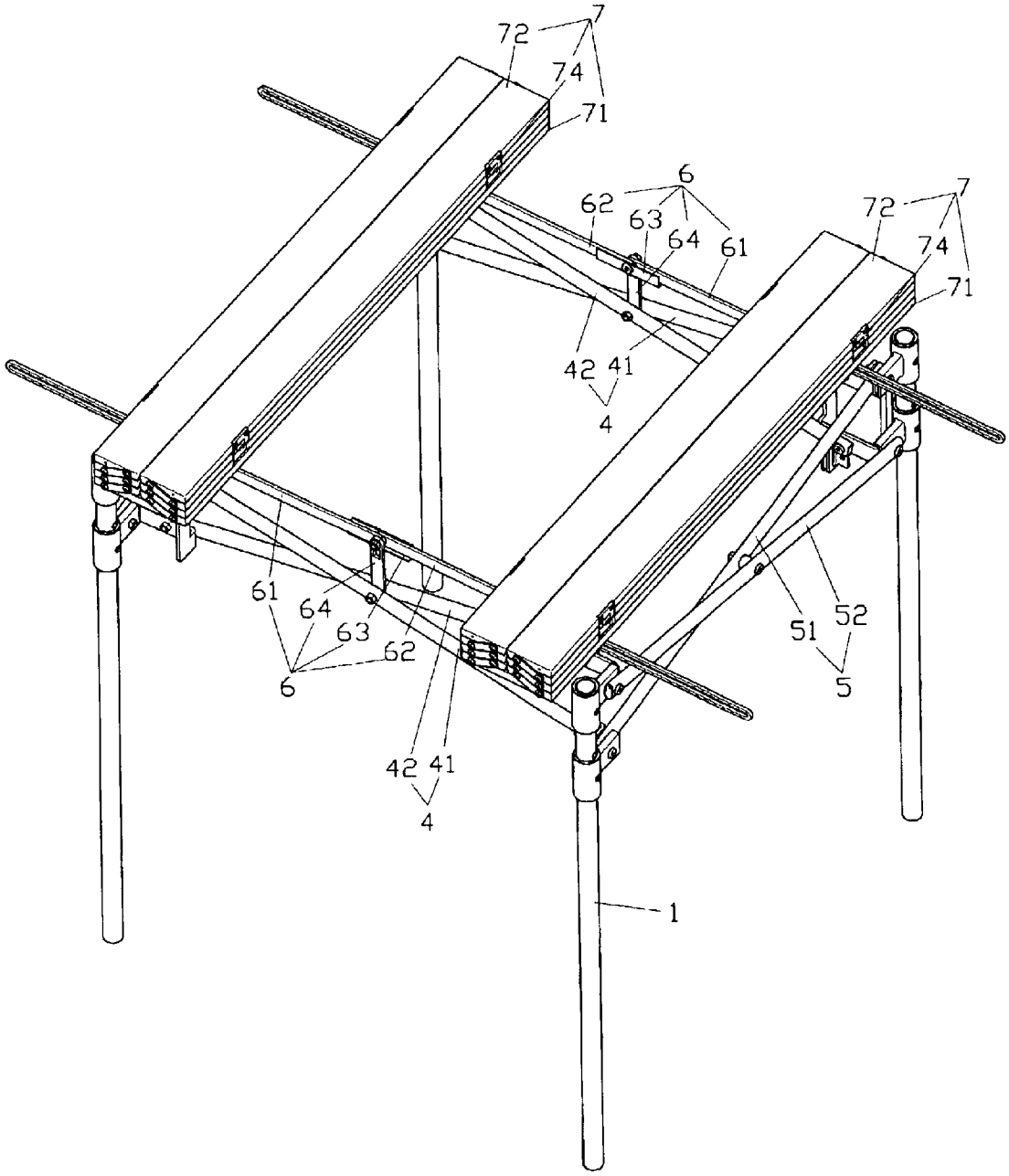
FIG. 15 is a view showing tabletops are placed flat on the supports of the present invention.
Figure 16:
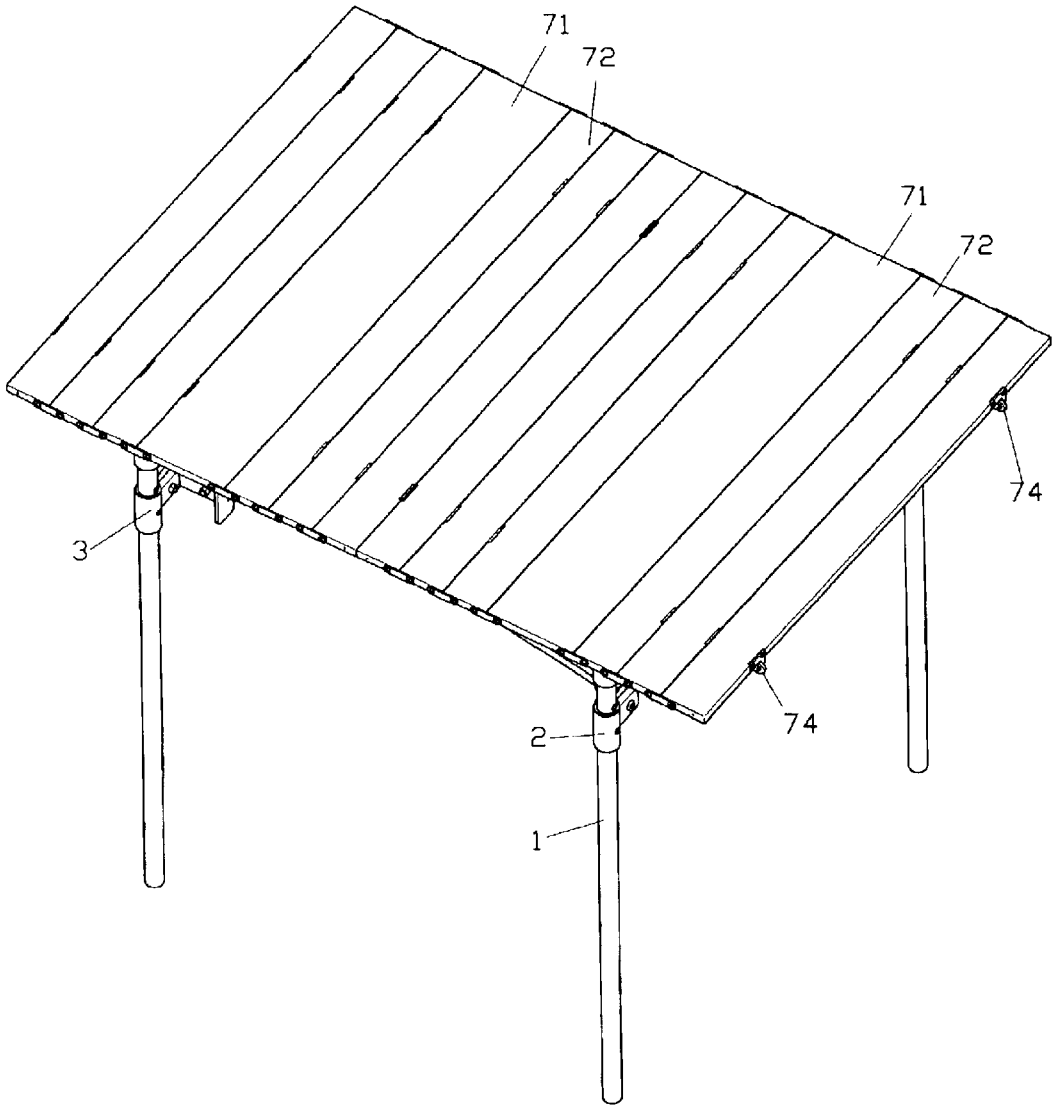
FIG. 16 is a view showing that tabletops of present invention are fully extended.

Upon unfolding the tabletops (7) as illustrated in FIG. 1, the four legs (4) are respectively stretched to four corners and secured in position. Meanwhile, the first and the second slide carriages (2, 3) elevate up to where below the four fixation holders (11) as illustrated in FIG. 14 and the two tabletops (7) as linked to the two second slide carriages (3) are also rising with both of the first and the second linkages (4, 5) stretching out to their extreme extent. As both supports (6) also rise, the first and the second rods (61, 62) of the supports (6) are in their straight horizontal status since terminals of the two slide ways (611, 621) are retained by the pivoting element (A). Meanwhile, the support portion (641) below the support plate (64) holds against another pivoting element (A) between the two first and the second rods (41, 42) of the fourth linkage (4). The two tabletops (7) are turned with the pivoting element (A) in the slide way (731) below the top panel (71) as the axial to be placed flush on the two supports (6) as illustrated in FIG. 15. The slide holder (73) below the top panel (71) is merely striding over and placed in the reception part (612) of the support (6) for the two tabletops (7) to be in a flat status. The boards (72) are then extended towards both sides of the top panel (71) and placed flush on the two supports (6) as illustrated in FIG. 16. Finally, the two locking hooks (74) on the outer side of the two top panels (71) are respectively locked to the front ends of the two slide ways (611, 621) to hold the two tabletops (7) in position for the tabletops (7) to be fully extended for use.

Figure 17:
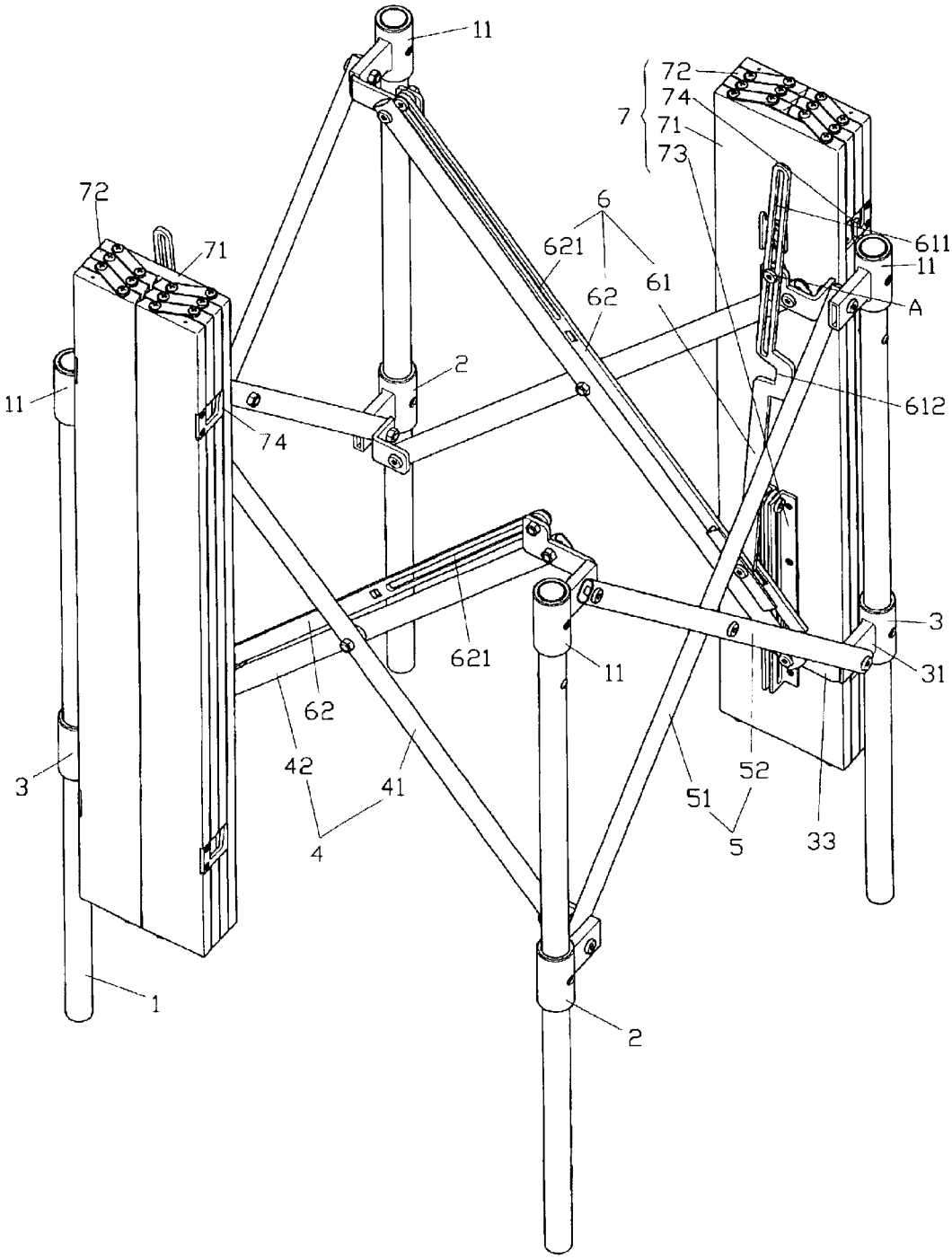
FIG. 17 is a view showing that tabletops of present invention are folded.
Figure 18:
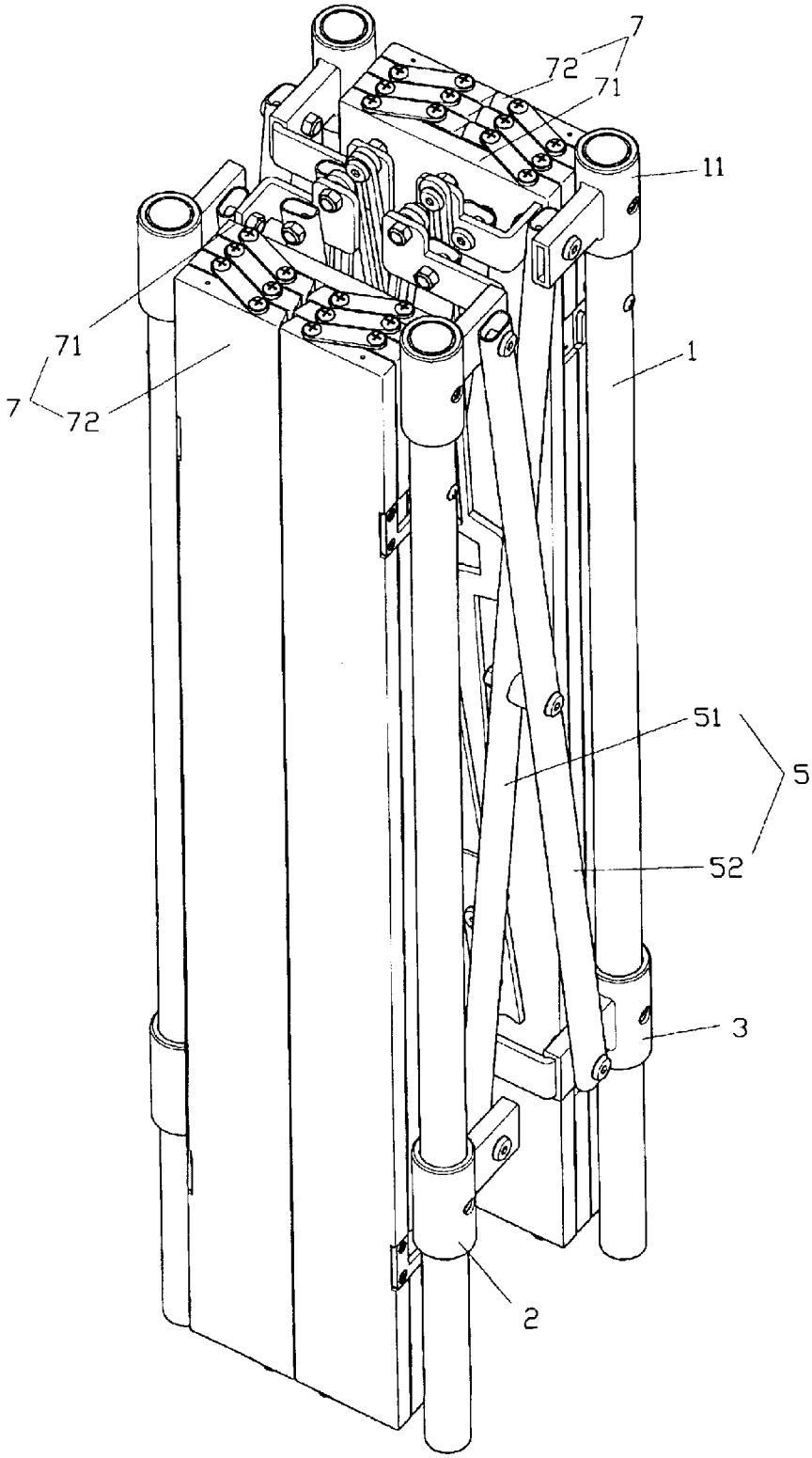
FIG. 18 is a view showing that the present invention is fully folded up for storage.

Upon folding up the table for storage in reverse order of unfolding as illustrated in FIG. 16, the two locking hooks (74) on the outer side of the two top panels (71) are released from the two slide ways (611, 621). The boards (72) extended to both sides of the two top panels (71) are folded into a stack at where above the two top panels (71) as illustrated in FIG. 15. With the pivoting element (A) in the slide way (731) below the top panels (71) as the axial to turn the two tabletops (7) so that both tabletops (7) to vertically bind to each other to the outer side of the two supports (6) before closing in four legs (4) towards the center as illustrated in FIG. 1. The first and the second slide carriages (2, 3) move downward along the legs (1) while the two tabletops (7) linked to the two second slide carriages (3) descend. All the lower ends of the first and the second rods (41, 42, 51, 52) from the first and the second linkages (4, 5) also move downward and close in together with the two supports (6). The slide way (611) moves downward and both pivoting elements (A) each at the terminal respectively of the slide ways (611, 621) gradually move to the front ends of the slide ways (611, 621) as illustrated in FIG. 17 until all four legs (1) are folded in towards the center as illustrated in FIG. 18 to complete folding the table to its least volume for storage.

Figure 19:
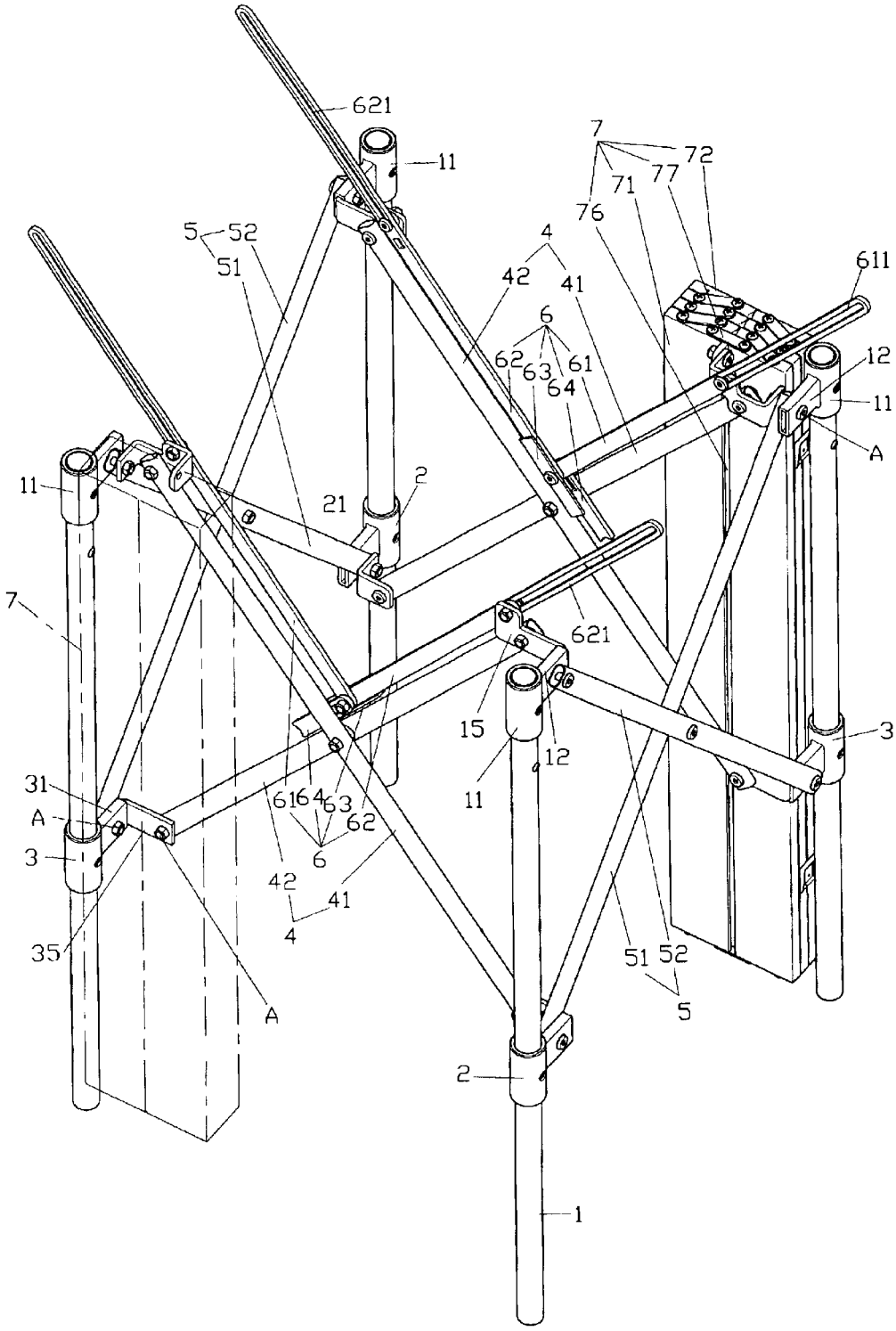
FIG. 19 is a perspective view of another preferred embodiment of the present invention.
Figure 20:
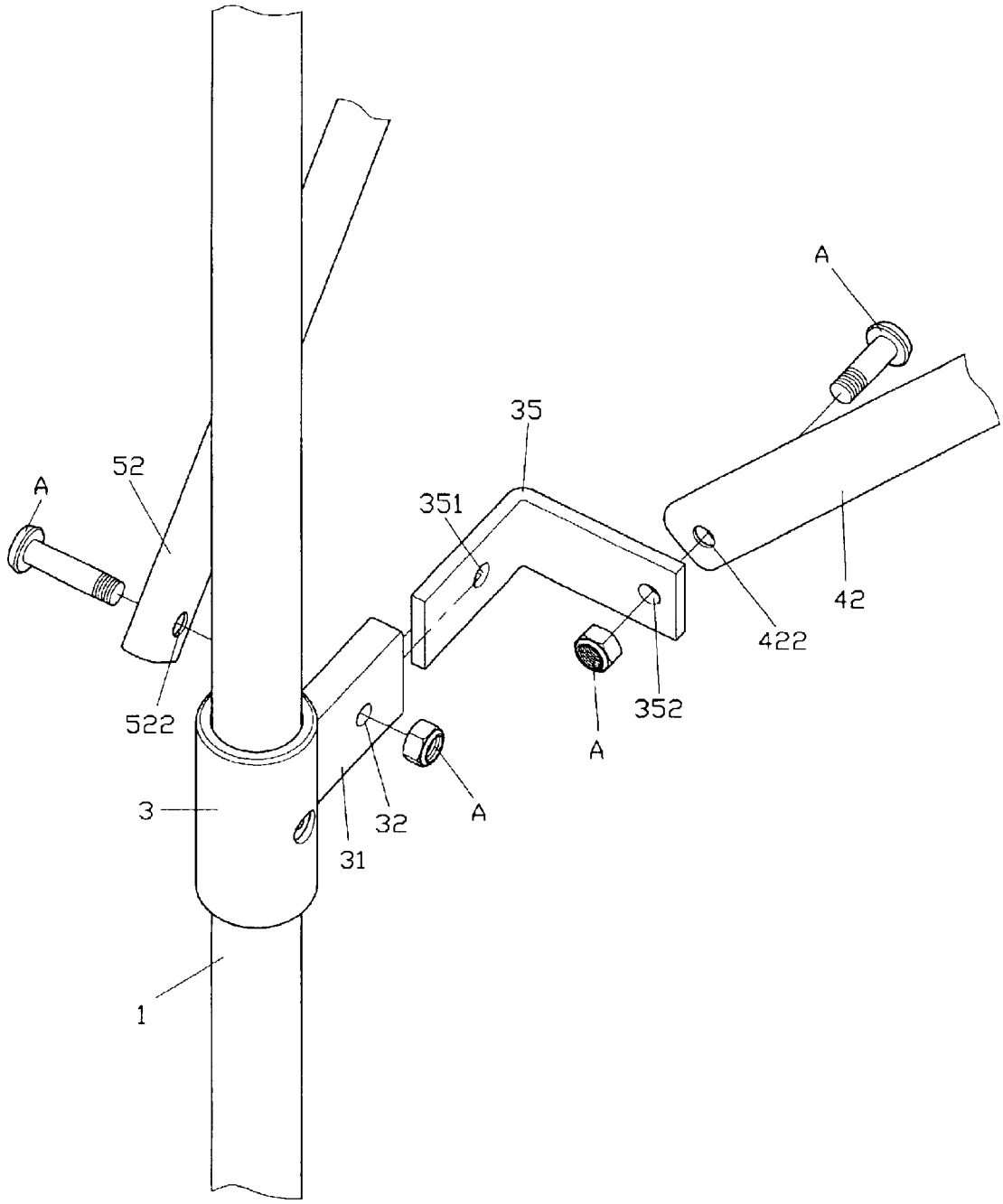
FIG. 20 is an exploded view of a fifth connector of the present invention.
Figure 21:
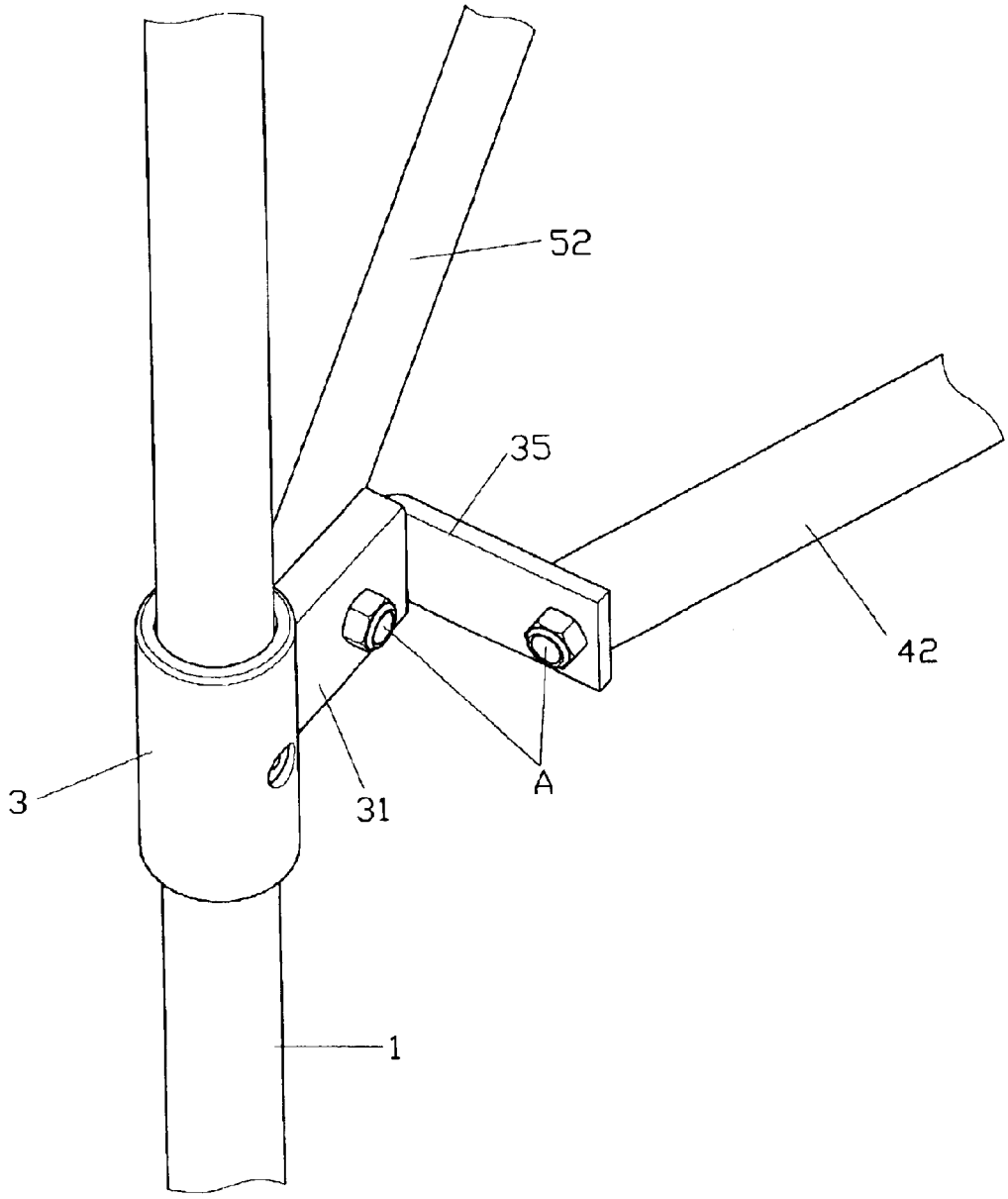
FIG. 21 is a perspective view of the fifth connector of the present invention as assembled.
Figure 22:
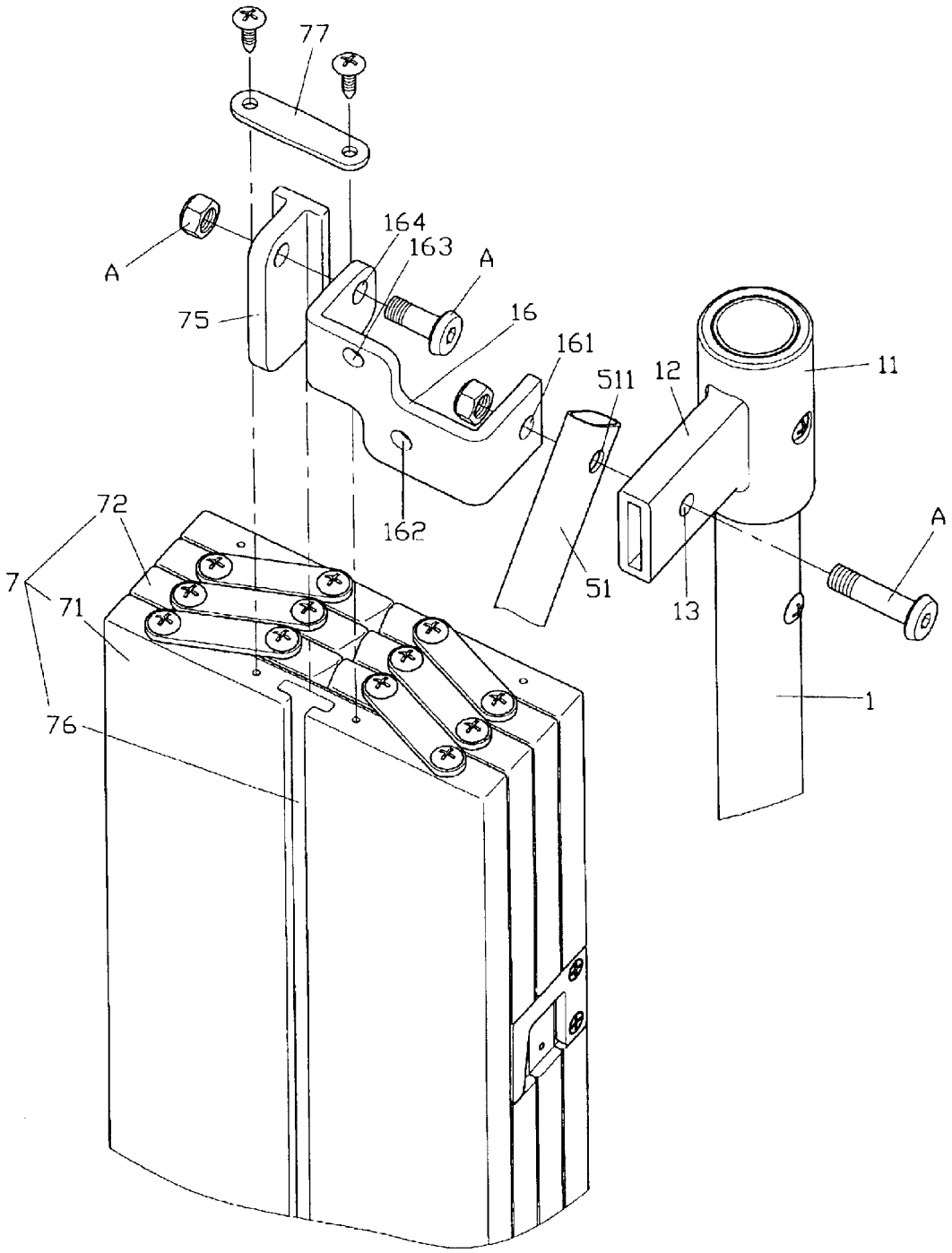
FIG. 22 is an exploded view of a sixth connector of the present invention.
Figure 23:
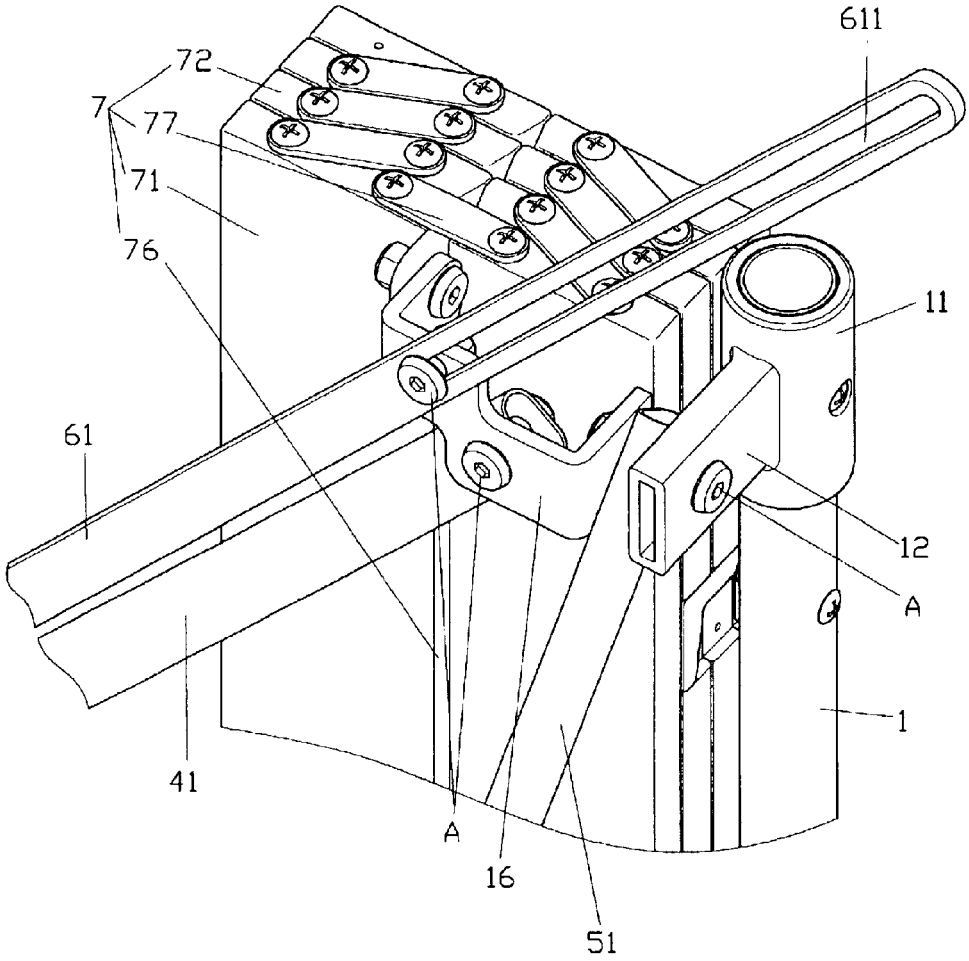
FIG. 23 is a perspective view of the sixth connector of the present invention as assembled.

FIG. 19 shows another preferred embodiment of the present invention. A fifth connector (35) is pivoted by means of a pivoting element (A) to the hole (32) in the pivot (31) of each of the two second slide carriage (3) as illustrated in FIGS. 20 and 21. The fifth connector (35) is an "L" shape with one side provided with a first hole (351) in relation to the hole (32) in the pivot (31) of is the second slide carriage (3) and the hole (522) in the second rod (52) of the second linkage (5). On the other side of the fifth connector (35) is provided with a second hole (352) pivoted by means of another pivoting element (A) to the hole (422) in the second rod (42) of the first linkage (4). Each hole (13) in the pivot (12) of the fixation holder (11) of two out of the four legs (1) opposite to each other is pivoted to a sixth connector (16) by means of another pivoting element (A) (as illustrated in FIGS. 22, 23). The sixth connector (16) has one side provided with a first hole (161) for the hole (511) in the first rod (51) of the second linkage (5) to be pivoted to one side of the hole (13) in the pivot (12). On the middle side of the sixth connector (16) are provided with a second and a third holes (162, 163). The second hole (162) is pivoted by means of a pivoting element (A) to the hole (411) in the first rod (41) of the first linkage (4) while the third hole (163) is pivoted by means of another pivoting element (A) to the slide way (611) in the first rod (61) of the support (6). As illustrated in FIGS. 22 and 23, on the other side of the sixth connector (16) is provided with a fourth hole (164) pivoted by means of another pivoting element (A) to a slider (75) in a "T" shape. The slider (75) is provided inside a slide track (76) at the bottom of the top panel (71) and both ends of the slide track (76) are provided each with a retainer (77) to prevent the slider (75) from falling out of the track (76) as the slider (75) moves inside the track (76). Furthermore, where the first rod (61) nears the terminal of the slide way (611) of the first rod (61) is made flat and straight to firmly support the top panel (71).

Figure 24:
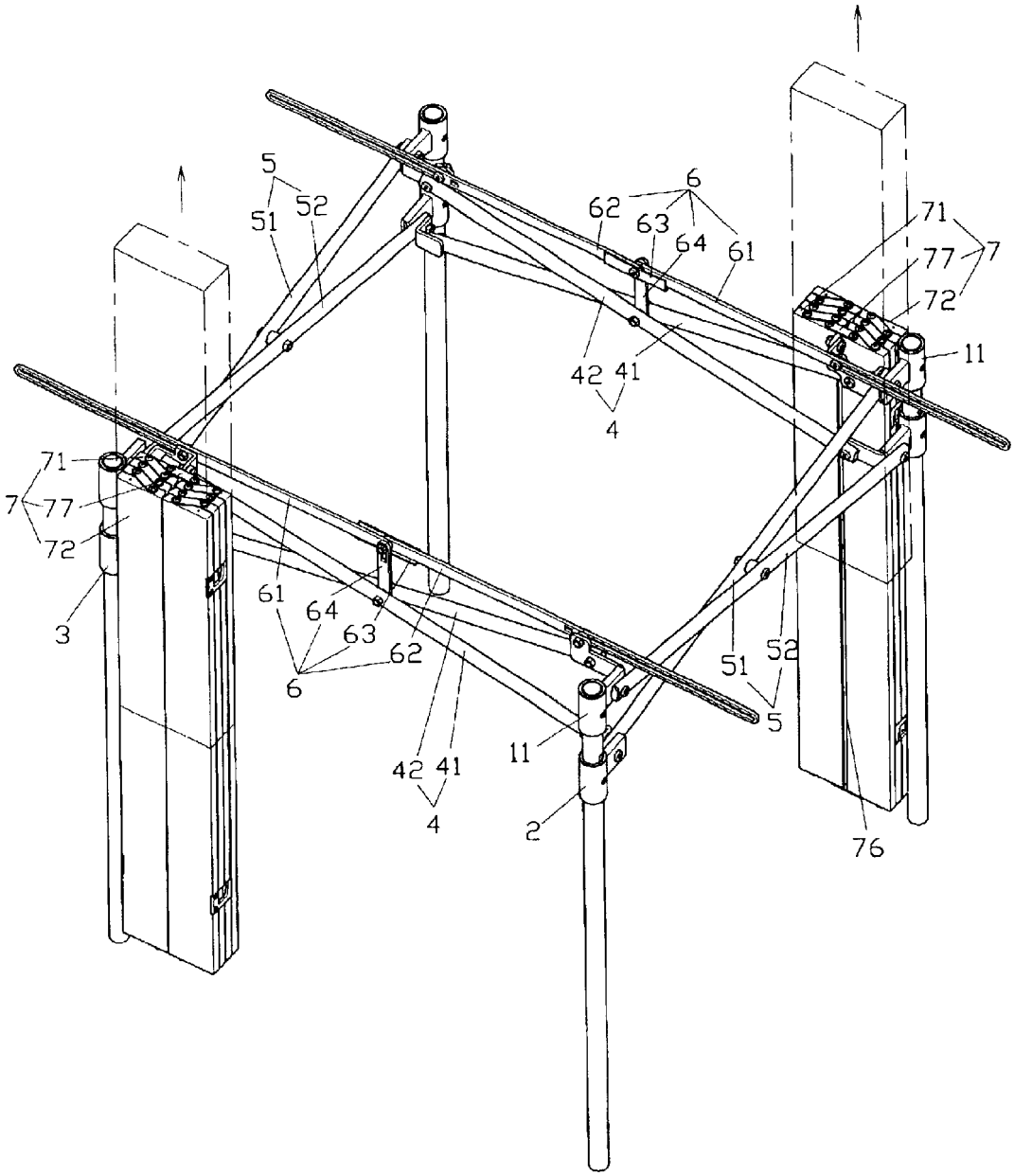
FIG. 24 is a view showing that another preferred embodiment of the present invention is in use.

Now referring to FIG. 24, upon stretching out the two tabletops (7), four legs (1) are respectively extended towards and held in position to four corners for the first and the second slide carriages (2, 3) to rise along the legs (1) up to where below the four fixation holders (11) while both first and both second linkages (4, 5) are stretched out to their extremes. With the two supports (6) also rise for the terminals of the slide ways (611, 621) to be retained by the pivoting element (A), thus to make both of the first and the second rods (61, 62) of the supports (6) to be situated in straight horizontal status. Meanwhile, the support portion (641) below the support plate (64) holds against the pivoting element (A) between the first and the second rods (41, 42) of each of the first linkage (4). Then, the two tabletops (7) are pushed upward for the slider (75) at the bottom of the two top panels (71) to slide inside the slide track (76) until to reach its highest point where both tabletops (7) are turned with the pivoting element (A) in the slider (75) for the slider (75) to turn for 90 degrees to place flat those two tabletops (7) on the two supports (6). Once the boards (72) are pulled and placed flush towards both sides of the two top panels (71), the two tabletops (7) are fully extended and ready for use. Upon unfolding the table, reverse the folding procedure in sequence to achieve the same for reducing the storage volume for the table to the least.

As disclosed, the present invention offers the following advantages:

1. The table adapted with the present invention can be easily folded up to reduce its size for storage or for handling in case of outdoors use is required.
2. When not in use, the table can be folded up for storage in the least consumption of space and is particularly practical for modern home unit with a limited floorage.

I claim:

1. A foldable table comprising four legs, two first slide carriages, two second slide carriages, two first linkages, two second linkages, and two tabletops wherein:

each of said legs being provided with a fixation holder and a plurality of holes being provided in said fixation holder;

said two first slide carriages being respectively inserted in two of said four legs opposite to each other and a plurality of holes being provided on each of said two first slide carriages;

said two second slide carriages being respectively inserted in another two of said four legs opposite to each other and a plurality of holes being provided on each of said two second slide carriages;

said two first linkages being respectively provided to two of said four legs opposite to each other on the same side; each of said first linkages comprising a first rod and a second rods pivoted in cross to each other; upper ends of said first and said second rods being pivoted to respective fixation holders; and lower ends of said first and said second rods being respectively pivoted to said first and said second slide carriages;

said two second linkages being respectively provided to another two of said four legs opposite to each other on the same side; each of said second linkages comprising a first rod and a second rods pivoted in cross to each other; upper ends of said first and said second rods being pivoted to respective fixation holders; and lower ends of said first and said second rods being respectively pivoted to said first and said second slide carriages;

two supports being respectively pivoted to two legs opposite to each other on the same side of said first linkage; each of said two supports comprising a first rod and a second rods pivoted to each other; one end of the first and the second rods being respectively pivoted to a pivoting plate; and another end being provided with a slide way to be pivoted to said fixation holder; and said two tabletops being placed on said two supports in an extended position, each said tabletop including a top panel and a plurality of boards foldably extending therefrom, whereby said boards and said top panels being folded up for storage, each said tabletop being pivotally coupled to at least one of said second slide carriages for pivotal displacement from the extended position to a storage position.

2. The foldable table as claimed in claim 1, wherein, a pivot is protruded from each of said fixation holders; two pivots from two legs opposite to each other being pivoted to a first connector; said first connector being provided with a first hole to be pivoted to said pivot and an upper end of said first rod of said second linkage; a second hole to be pivoted to an upper end of said first rod of said first linkage; a third hole to be pivoted to said slide way in said first rod of said support; two pivots from the other two legs opposite to each other being pivoted to a second connector; said second connector being provided with a first hole to be pivoted to said pivot and an upper end of said second rod of said second linkage; a second hole to be pivoted to an upper end of said second rod of said first linkage; and a third hole to be pivoted to said slide way in said second rod of said support.

3. The foldable table as claimed in claim 1, wherein, a pivot is protruded from said first slide carriage; a third connector being pivoted to said pivot; a first hole provided in said third connector being pivoted to said pivot and an lower end of said first rod of said second linkage; and a second hole provided in said third connector being pivoted to lower end of said first rod of said first linkage.

4. The foldable table as claimed in claim 1, wherein, a pivot is protruded from said second slide carriage; a fourth connector being pivoted to said pivot; a first hole provided in said fourth connector being pivoted to said pivot and a lower end of said second rod of said second linkage; a second hole provided in said fourth connector being pivoted to a lower end of said second rod of said first linkage; and a slider being provided with a hole to be pivoted below said tabletops.

5. The foldable table as claimed in claim 1, wherein, a reception part is defined by a recess at said first rod of said support close to a terminal of said slide way.

6. The foldable table as claimed in claim 1, wherein, a support plate is separately pivoted to said pivoting plate, and a support portion is provided below said support plate.

7. The foldable table as claimed in claim 1, wherein, said boards are respectively pivoted to both sides of said top panel, a slide holder is respectively provided below said top panel; a slide way slot is provided in said slide holder and pivoted to said second slide carriage.

8. The foldable table as claimed in claim 1, wherein, a locking hook is provided on an outer side of said top panel and said locking hook is locked inside said slide ways respectively disposed in said first and said second rods of said support.

9. The foldable table as claimed in claim 1, wherein, a pivot is protruded from said second slide carriage; a fifth connector is pivoted to said pivot; a first hole being provided in said fifth connector to be pivoted to said pivot and a lower end of said second rod of said second linkage; and a second hole provided in said fifth connector to be pivoted to a lower end of said second rod of said first linkage.

10. The foldable table as claimed in claim 1, wherein, a pivot is protruded from each of said fixation holders; each of said legs opposite to each other being pivoted to a sixth connector; said sixth connector being provided with a first hole to be pivoted to an upper end of said first rod of said second linkage and to said pivot; a second hole provided in said sixth connector being pivoted to an upper end of said first rod of said first linkage; a third hole being further provided in said sixth connector to be pivoted to said slide way in said first rod of said support; and a fourth hole being provided in said sixth connector to be pivoted below said tabletop.

11. The foldable table as claimed in claim 1, wherein, said boards are respectively pivoted to both sides of each of said top panel and a slide track is provided below said top panel to accommodate a slider which is pivoted to said fixation holder.

12. The foldable table as claimed in claim 11, wherein, both ends of said slide track of said top panel are each fixed with a retainer.

* * * * *